United States Patent [19]

Godfrey et al.

[11] 4,300,070

[45] Nov. 10, 1981

[54] CATHODE-RAY TUBE SCREEN BORDER IMPROVEMENT

[75] Inventors: Richard H. Godfrey; James O. Peck, both of Lancaster, Pa.

[73] Assignee: RCA Corporation, New York, N.Y.

[21] Appl. No.: 47,218

[22] Filed: Jun. 11, 1979

Related U.S. Application Data

[63] Continuation-in-part of Ser. No. 965,240, Nov. 30, 1978, abandoned.

[51] Int. Cl.[3] ..... H01J 29/07; H01J 29/18

[52] U.S. Cl. ..... 313/403; 313/408

[58] Field of Search ..... 313/403, 408

[56] References Cited

U.S. PATENT DOCUMENTS

| | | | |
|---|---|---|---|
| 3,766,419 | 10/1973 | Barbin | 313/403 X |
| 3,856,525 | 12/1974 | Inoue | 313/403 X |
| 3,947,718 | 3/1976 | Van Lent | 313/403 X |

FOREIGN PATENT DOCUMENTS

| | | | |
|---|---|---|---|
| 2306014 | 8/1973 | Fed. Rep. of Germany | 314/408 |
| 2656995 | 10/1978 | Fed. Rep. of Germany | 313/403 |

OTHER PUBLICATIONS

European Patent Application No. 0 001 673, Date of Publication of Application 5-1979, 1 Sht. Drawing, 4 pages specification.

*Primary Examiner*—Palmer C. Demeo

*Attorney, Agent, or Firm*—Eugene M. Whitacre; Glenn H. Bruestle; Dennis H. Irlbeck

[57] ABSTRACT

The present invention provides an improved cathode-ray tube of a type having a cathodoluminescent line screen and slit apertured mask mounted within the tube in spaced relation to the screen, wherein the slits in the mask are aligned in substantially parallel columns, each column containing a plurality of slits which are vertically separated by web portions of the mask. In the tube, some of the end portions of the aperture columns are modified to produce a more asthetically pleasing screen border.

5 Claims, 6 Drawing Figures

PRIOR ART

CATHODE-RAY TUBE SCREEN BORDER IMPROVEMENT

This is a continuation-in-part of application Ser. No. 965,240, filed Nov. 30, 1978, now abandoned.

BACKGROUND OF THE INVENTION

This invention relates to cathode-ray tubes having cathodoluminescent line screens and slit apertured masks therein, and particularly to a screen structure of improved visual acceptance.

Recent cathode-ray tubes developed and marketed for use in color television receivers have spherically-contoured rectangular faceplates with line screens of cathodoluminescent materials thereon and somewhat spherically contoured slit-apertured shadow masks adjacent to the screens. The mask slits are aligned in parallel vertical columns. Each column contains a plurality of slits which are vertically separated by web portions of the mask. The web portions in adjacent columns are vertically staggered relative to each other. Because of this staggering and because the slit apertures generally are held constant in length, designated top and bottom border lines primarily cut through apertures in each column but also, often cut through web portions. The net effect on the screen of having some columns abutting the desired borderline with webs while the remaining columns abut the border line with apertures is the formation of steps in some portions of the top and bottom borders of the screen. Such steps in the screen can be seen by an observer sitting close to the screen and therefore are aesthetically undesirable.

SUMMARY OF THE INVENTION

The present invention provides an improved cathode-ray tube of a type having a cathodoluminescent line screen and slit apertured mask mounted within the tube in spaced relation to the screen, wherein the slits in the mask are aligned in substantially parallel columns, each column containing a plurality of slits which are vertically separated by web portions of the mask. In the tube, some of the end portions of the aperture columns are modified to produce a more aesthetically pleasing screen border.

DETAILED DESCRIPTION

Figure 1:
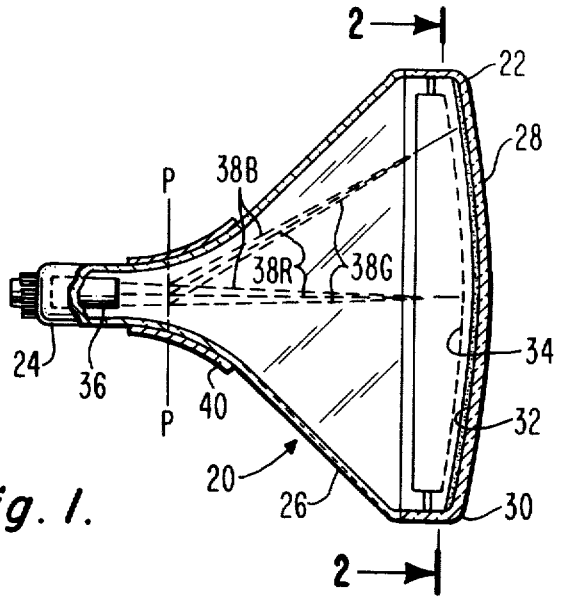
FIG. 1 is a plan view in axial section of an apertured mask cathode-ray tube.
Figure 2:
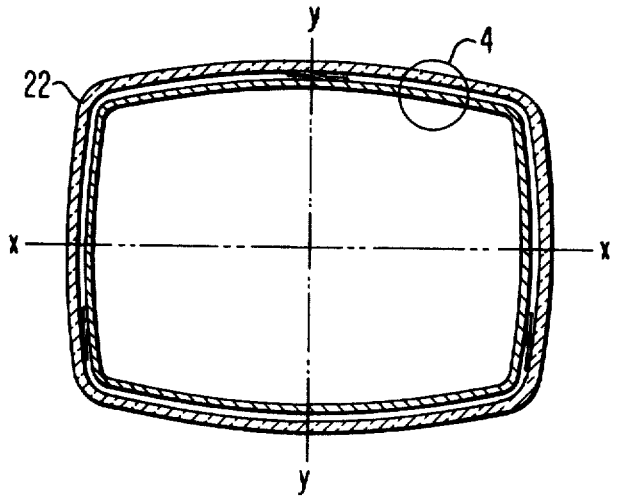
FIG. 2 is a back view of the mask and faceplate taken at section line 2—2 of FIG. 1.

FIG. 1 illustrates a rectangular color picture tube having an evacuated glass envelope 20 comprising a rectangular panel 22 and a tubular neck 24 joined by a funnel 26. An interior view of the panel is shown in FIG. 2. The panel 22 comprises a viewing faceplate 28 and a peripheral flange or sidewall 30 which is sealed to the funnel 26. A mosaic three-color cathodoluminescent line screen 32 is located on the inner surface of the faceplate 28 and comprises an array of phosphor lines extending substantially parallel to the vertical axis (y—y) of the tube. The area between the cathodoluminescent lines may be filled with a light absorbing material. A multiapertured color selection electrode or shadow mask 34 (illustrated schematically) is removably mounted within the panel 22 in predetermined spaced relationship to the screen 32. The mask 34 includes a multiplicity of slit shaped apertures which are aligned in substantially parallel vertical columns. Each column contains a plurality of slits which are vertically separated by web portions in the mask. The web portions in adjacent columns are vertically staggered so that the apertures lie in a common brick-shaped pattern when viewed sideways.

An inline electron gun 36 (illustrated schematically) is mounted within the neck 24 to generate and direct three electron beams 38B, 38R and 38G along co-planar convergent paths through the mask 34 to the screen 32.

The tube of FIG. 1 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to vertical and horizontal magnetic fields that cause the beams to scan horizontally and vertically in a rectangular raster over the screen 32. For simplicity, the actual curvature of the paths of the deflected beams in the deflection zone is not shown in FIG. 1. Instead, the beams are schematically shown as having an instantaneous bend at the plane of deflection P—P.

Figure 3:
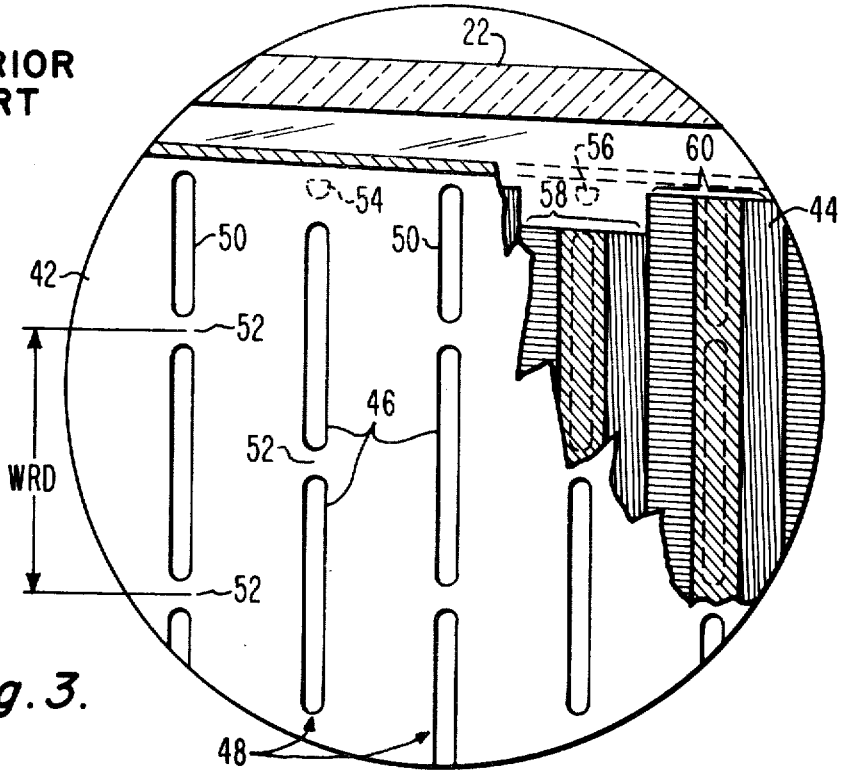
FIGS. 3 and 4 are enlarged views of a portion of a tube indicated by circle 4 in FIG. 2 for a prior art tube and a tube incorporating one embodiment of the present invention, respectively.
Figure 4:
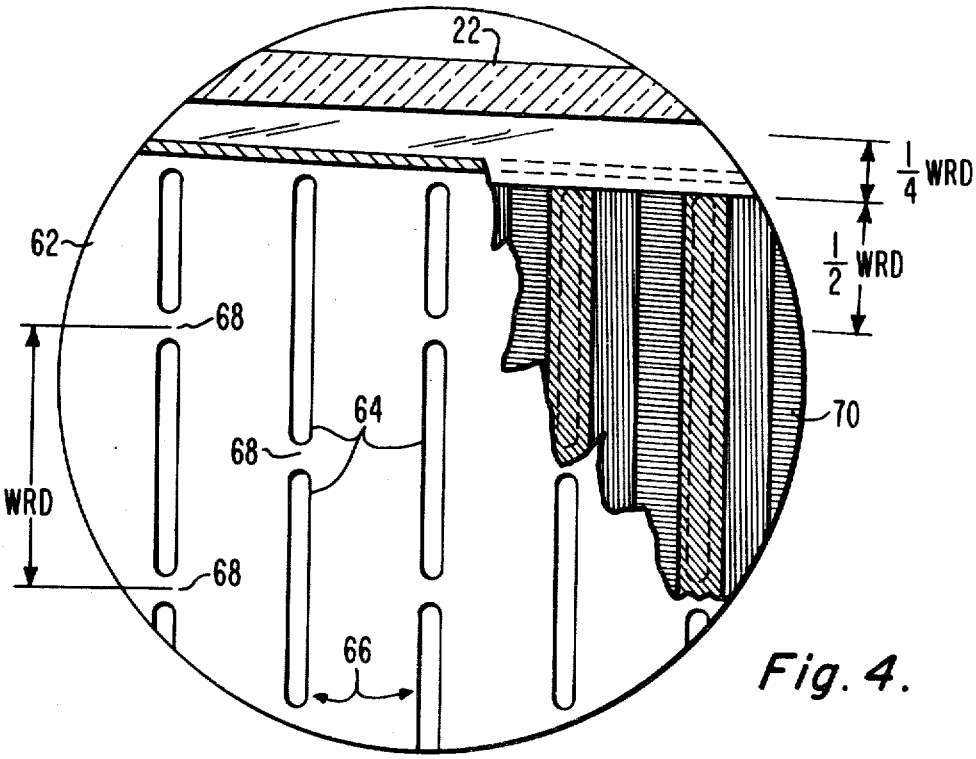

Enlarged views of a portion of the panel 22, designated by circle 4 in FIG. 2, are presented in FIGS. 3 and 4 for a prior art tube and for a tube containing an embodiment of the present invention, respectively. FIG. 3 shows a prior art apertured mask 42 partially broken away to reveal a portion of a tube screen 44. The mask 42 includes a plurality of slit apertures 46 aligned in columns 48. With the exception of some apertures 50 near the mask periphery, all slit apertures 46 are of equal length. Each aperture 46 in each column 48 is separated from an adjacent aperture in the same column by a web portion of the mask. In the small portion of the mask shown, these web portions are of essentially equal length measured in the longitudinal direction of the slit apertures. The center-to-center distance between consecutive web portions 52 in the same column is the vertical web repeat distance WRD. The web repeat distance is continued throughout the mask. Because of the web repeat pattern and because it is desirable to have the screen borders parallel the slightly curved contours of the top and bottom of the panel 22 and mask 42, a designated borderline will generally cut the aperture columns at aperture locations but also will occasionaly cut through a web or near enough to a web so that there is insufficient aperture pattern for complete etching to take place. Such patterned but unetched apertures are indicated by dashed positions 54 and 56 in FIG. 3. Since the mask is used as a photomaster in forming the screen, the effect of having the desired border line passing through or near a web portion is to form a screen that has an irregular jagged top and bottom border. An example of this irregular border is shown in FIG. 3 wherein a triad of phosphor lines 58 ends at a lower point than does an adjacent triad 60 since a partial aperture 56 (shown in phantom) did not etch open.

A portion of an improved tube having a regular smoothly contoured top and bottom screen border is shown in FIG. 4. A mask 62 has the same slit aperture configuration over most of the mask as does the mask 42 of FIG. 3, except that the aperture pattern of some columns is modified at the top and bottom periphery to ensure that all aperture columns have full width and slit apertures abutting the desired border line. The mask 62 includes a plurality of slit apertures 64 aligned in columns 66 with the apertures 64 in each column being separated by webs 68. The center-to-center spacing between webs 68 in the major central portion of the mask 62 is the web repeat distance WRD. In this embodiment, all webs having centers that would occur within one-half the web repeat distance from the desired border line are omitted. Actually during plotting of the aperture pattern during formation of a photomaster which is used in photoexposing the screen, any webs having centers that would occur either one-half WRD within the border or one-half WRD outside the border, if the aperture pattern were continued beyond the border, are omitted. Web patterns outside the border are omitted since the border patterns may be slightly shifted thereby affecting the intercept of the borderline with the columns and also to prevent the tapering at the ends of the slit apertures from affecting the borderline contour of the screen. The effect of eliminating webs from near the aperture pattern border ensures that all columns will have full width end apertures that will extend to the upper and lower desired border lines. Since the aperture columns end along a smoothly contoured line, the resultant screen 70 also has smoothly contoured top and bottom borders as shown in FIG. 4.

Although the web repeat distance has been described herein as being a constant, it is to be understood that the scope of the present invention also covers embodiments where the web repeat distance may vary slightly over the mask to accomplish specific goals. Furthermore, although the invention has been described with respect to a tube having vertically extending aperture columns, the invention is also applicable to a tube having horizontally extending slit aperture columns.

Figure 5:
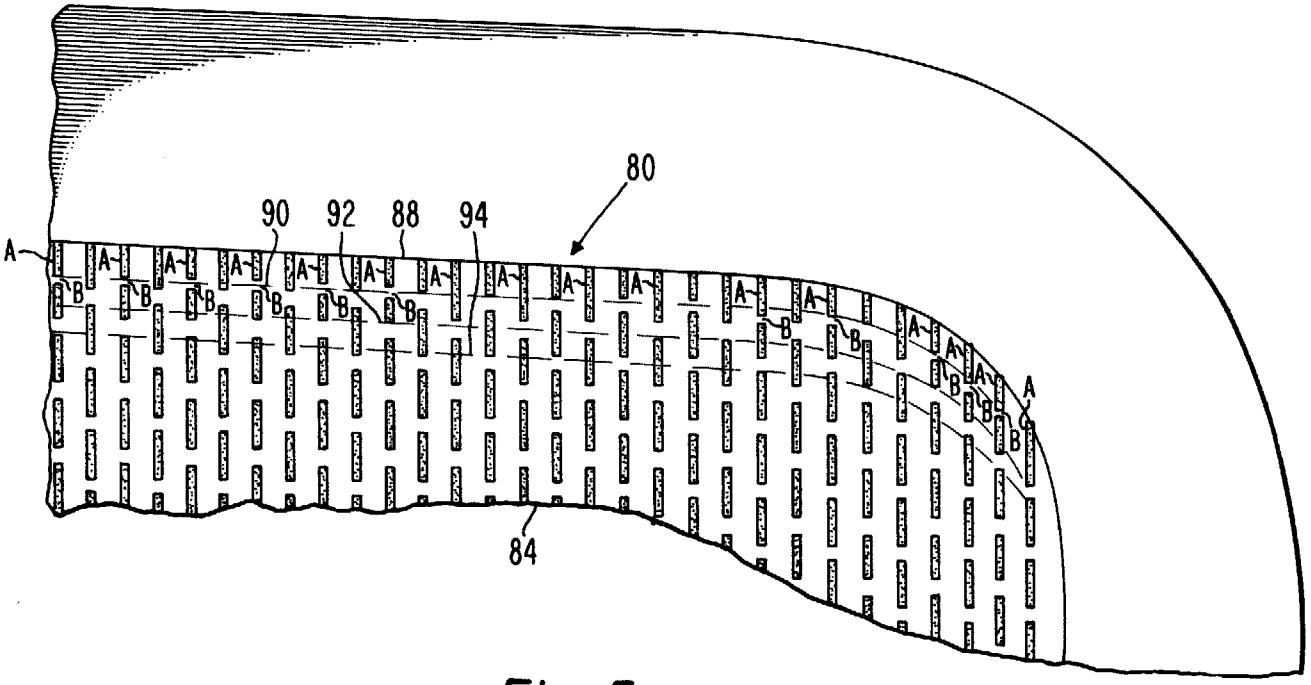
FIGS. 5 and 6 are enlarged views of portions of photomasters for exposing opposite sides of a shadow mask structured in accordance with the invention.
Figure 6:
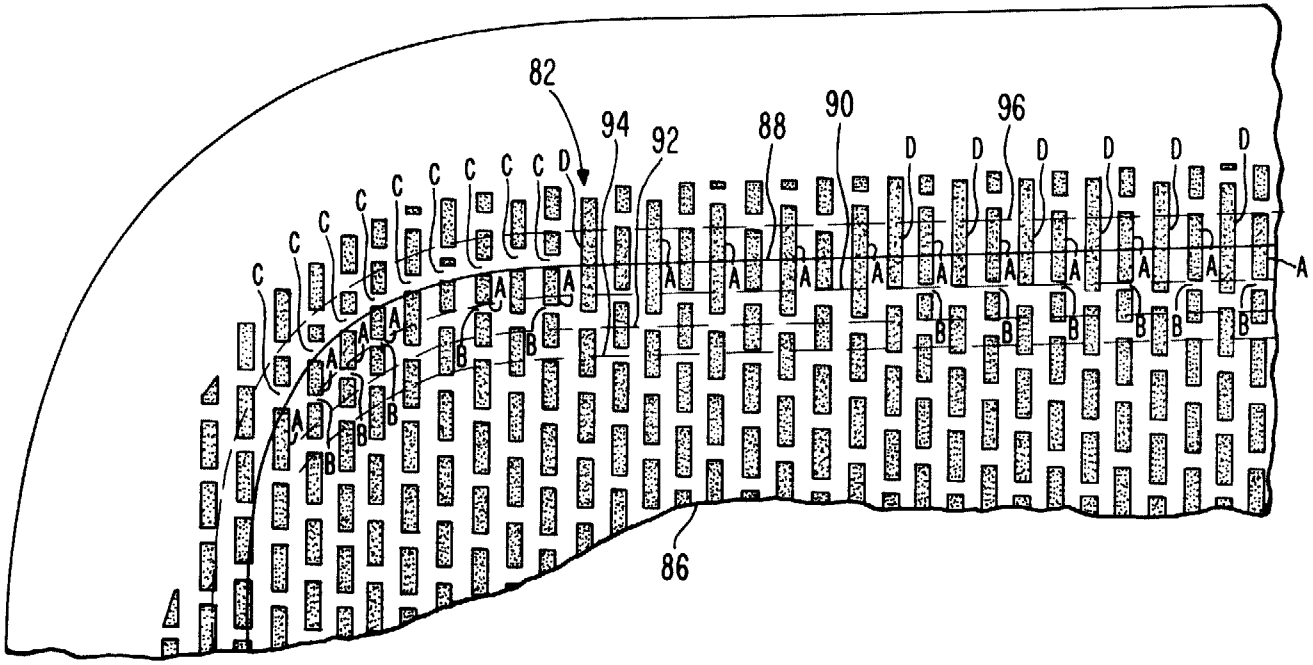

A shadow mask is usually constructed with the aperture openings on the screen side of the mask larger than the aperture openings on the gun side of the mask. Such apertures are formed by first coating a sheet of unetched mask material with a photosensitive coating and then by photoexposing the coating through related photomasters from opposite sides of the sheet. Thereafter, the coating is developed and the sheet is etched to form the apertures. FIGS. 5 and 6 show aperture patterns 80 and 82 of shadow mask photomasters 84 and 86, respectively, used for exposing opposite sides of a shadow mask. The pattern 80 of FIG. 5 represents the aperture openings that will be established on the gun side of the mask and the pattern 82 of FIG. 6 represents the aperture openings to be opened on the screen side of the mask. In each drawing, the border of the aperture array is shown by the line 88. In the gun side pattern 80, the elements of the pattern end at the borderline 88, but in the screen side pattern 82 the elements of the pattern extend beyond the borderline 88. The purpose of extending the pattern array on one side of the mask beyond the intended aperture region is to form blind indentations in the mask to relieve the stresses occurring in the mask during its formation into a domed shape. By weakening the peripheral area just outside the aperture array, the stress on the mask webs is somewhat lessened and the chance of web tearing during formation is reduced.

IN FIGS. 5 and 6, the dashed line 90 inside the borderline 88 represents a spacing of one half the web repeat distance. As can be seen, no web centers are located between the dashed line 90 and the borderline 88, thus providing a smooth contour around the periphery of the aperture array. Locations where webs would have occurred in a prior art tube having a set web repeat distance are indicated by an "A". However, it has been found by experimentation that the elimination of some webs in this peripheral area creates problems. For example, when an end aperture became too long because of the elimination of a web, excessive distortion of the aperture occurred during formation of the mask into a domed contour. Therefore, to compensate for this deformation, additional webs are added to the patterns just outside the one half web repeat distance limit. These additional webs are labeled "B" in the drawings. Generally, when no web center falls between 1.1 to 1.5 of the web repeat distance from the borderline 88, a web should be added. In the embodiment of FIGS. 5 and 6, the 1.1 and 1.5 limits are designated by lines 92 and 94, respectively. The additional webs "B" were added at the center of the lengthened slit apertures. The vertical dimension of the added webs "B" is approximately half the vertical dimension of a regular web.

In the extended pattern on the screen side of the mask 86, shown in FIG. 6, the same criteria is used for removal of the web pattern as used within the border 88 except for the corners which will be discussed later. Removal of the patterned webs in the extension is necessary to prevent a partial web from being formed at the border 88 thereby affecting the shape or length of an aperture at the border 88. In FIG. 6, patterned webs, which have been removed within one-half web repeat distance 96 outside of the border 88, are designated by a "D".

A basic problem of overweakening occurs in the corners of the mask if the patterned webs are removed from the extended pattern. Therefore, to compensate for such overweakening, webs are added to the extended pattern at the corners of mask at the border 88 of the aperture pattern. The added webs are designated "C" in FIG. 6.

What is claimed is:

1. In a cathode-ray tube having a cathodoluminescent line screen and a slit apertured mask mounted within said tube in spaced relation to said screen, wherein the slits in said mask are aligned in substantially parallel columns, each column containing a plurality of slits which are separated by web portions of said mask, and the web portions in adjacent columns being longitudinally staggered relative to each other, the improvement comprising smoothly contoured imaginary lines defining the borders of the array at the ends of the columns wherein each column includes a slit aperture at each end thereof abutting said smoothly contoured imaginary lines and no web centers are located in any column within a distance from said smoothly contoured imaginary lines equal to half the longitudinal length of a centrally located slit plus half a web.

2. In a cathode-ray tube having a cathodoluminescent line screen and a slit apertured mask mounted within said tube in spaced relation to said screen, wherein the slits in said mask are aligned in substantially parallel columns, each column containing a plurality of slits which are separated by web portions of said mask, and the web portions in adjacent columns being staggered relative to each other in the longitudinal direction of the columns, the improvement comprising each slit aperture at the end of a column being at least half the length of a central slit aperture and the ends of all columns being aligned along smoothly contoured borderlines.

3. The tube as defined in claim 2 wherein the borderlines to which the slit apertures are aligned are curved and somewhat parallel the contour of the top and bottom sides of a faceplate panel of said tube.

4. In a cathode-ray tube having a cathodoluminescent line screen and a slit apertured mask mounted within said tube in spaced relation to said screen, wherein the slits in said mask are aligned in substantially parallel columns, each column containing a plurality of slits which are separated by web portions of said mask, and the web portions in adjacent columns being staggered relative to each other in the longitudinal direction of the columns, the improvement comprising each slit aperture at the end of a column being at least half the length of a central slit aperture and the ends of all columns being aligned along smoothly contoured aperture borderlines, and the ends of all cathodoluminescent lines of said screen being aligned along smoothly contoured screen borderlines.

5. The tube as defined in claims 1, 2 or 4 wherein all columns include a web within 1.5 the repeat distance of either of the ends of said columns.

* * * * *